US005380564A

United States Patent [19]

VanKuiken, Jr. et al.

[11] Patent Number: 5,380,564

[45] Date of Patent: Jan. 10, 1995

[54] HIGH PRESSURE WATER JET METHOD OF BLASTING LOW DENSITY METALLIC SURFACES

[75] Inventors: Lewis L. VanKuiken, Jr., Grand Rapids; Larry E. Byrnes, Rochester Hills; Martin S. Kramer, Washington, all of Mich.

[73] Assignees: Progressive Blasting Systems, Inc., Grand Rapids; General Motors, Detroit, both of Mich.

[21] Appl. No.: 77,677

[22] Filed: Jun. 15, 1993

Related U.S. Application Data

[63] Continuation-in-part of Ser. No. 875,280, Apr. 28, 1992, abandoned, and a continuation-in-part of Ser. No. 932,528, Aug. 20, 1992, abandoned.

[51] Int. Cl.[6] ..... B05D 1/08; B05D 3/00

[52] U.S. Cl. ..... 427/456; 427/455; 427/325

[58] Field of Search ..... 427/328, 455, 456

[56] References Cited

U.S. PATENT DOCUMENTS

| | | | |
|---|---|---|---|
| 3,918,137 | 11/1975 | Telang et al. | 29/156.4 |
| 3,959,030 | 5/1976 | Satake et al. | 148/12 R |
| 3,981,688 | 9/1976 | Telang et al. | 29/156.4 |
| 4,013,518 | 3/1977 | Miko | 202/241 |
| 4,176,883 | 12/1979 | Liesveld | 299/17 |
| 4,715,539 | 12/1987 | Steele | 239/263 |
| 4,744,517 | 5/1988 | Iwamoto et al. | 239/263 |
| 4,761,039 | 8/1988 | Hilaris | 299/39 |
| 4,869,090 | 8/1989 | Tada et al. | 72/53 |
| 4,948,674 | 8/1990 | Herold et al. | 428/469 |
| 4,980,996 | 1/1991 | Klink et al. | 51/290 |
| 5,045,352 | 9/1991 | Mueller | 427/235 |
| 5,080,056 | 1/1992 | Kramer et al. | 29/888.061 |
| 5,102,691 | 4/1992 | Russo et al. | 427/109 |
| 5,271,967 | 12/1993 | Kramer et al. | 427/456 |

FOREIGN PATENT DOCUMENTS

| | | | |
|---|---|---|---|
| 543609 | 11/1979 | Japan | 29/888.061 |
| 59-185778 | 10/1984 | Japan | 427/421 |

OTHER PUBLICATIONS

American Welding Society, Inc., "Thermal Spraying Practice, Theory, and Application," pp. 2, 3, 50 (no date).

Flow International Corporation advertising brochure "FLOWFACTS," Jul. 1991.

Metco Inc. technical bulletin, "Metco Sprasteel 25 Wire," Oct. 30, 1981.

*Primary Examiner*—Shrive Beck

*Assistant Examiner*—Katherine A. Bareford

*Attorney, Agent, or Firm*—Price, Heneveld, Cooper, DeWitt & Litton

[57] ABSTRACT

The method of treating the surfaces of malleable light metal cylinder bores or other objects by blasting the surfaces with extremely high water jets for preparing such surfaces for subsequent coating with wear-resistant materials such as a thermal spray coating. The water not only cleans the surface but roughens it to produce a pitted surface with undercuts so that coating material fills the pits and undercuts to provide a smooth layer of coating material with a strong mechanical/adhesive bond.

22 Claims, 4 Drawing Sheets

HIGH PRESSURE WATER JET METHOD OF BLASTING LOW DENSITY METALLIC SURFACES

This application is a continuation-in-part of application Ser. Nos. 07/875,280 and 07/932,528 filed Apr. 28, 1993, and Aug. 20, 1992, respectively, both now abandoned.

BACKGROUND OF THE INVENTION

This invention relates to the treatment of low density metallic surfaces prior to coating such surfaces. More specifically, it relates to the treatment of the surfaces of the cylinder walls of engine blocks with high pressure water jets and application of such coatings preferably by the thermal spray process.

There are applications in the design and manufacture of commercial products in which it is desirable to apply a thermal spray metal coating to a base metal surface. There are different reasons for the application of such a coating. One important reason is that the applied coating may be more wear or corrosion resistant than the base layer.

In recent years, aluminum pistons and aluminum engine blocks have been used in automotive engines, but scuffing and wear due to the motion between the piston and the cylinder wall has created a problem. U.S. Pat. No. 5,080,056, which issued on Jan. 14, 1992, discloses this problem and the efforts made to solve it. Pat. No. 5,080,056 teaches a method of forming a scuff and wear resistant liner in a relatively low-silicon content aluminum alloy cast engine block. It discloses that engine blocks of a suitable low-silicon aluminum alloy, such as the aluminum 319 alloy, are readily cast into an engine block, and aluminum-bronze alloy compositions are applied by a thermal spray process onto the internal diameter of the cylinder bores of the aluminum casting. The patent discloses that before the thermal-sprayed composition is applied to the cylinder bore, it has to be machined to a suitable oversize dimension and then thoroughly cleaned and degreased so as to be in suitable condition for the thermal-sprayed coating to be adhered to the walls of the cylinder bore.

In the thermal spray technique, a high velocity oxy-hydrocarbon fuel practice is employed to melt and atomize an aluminum-bronze composition. The atomized droplets are sprayed onto the cylinder wall portions of the casting to form a dense coating of suitable thickness. There are, of course, many other applications in which it is desired to apply a thermal spray coating on a metal surface. However, this example of the engine block illustrates the problems and practices that arise in the formation of durable and adherent coatings by this technique.

Thermal spray methods differ in the way that the coating alloy is melted and atomized and propelled against a surface to be coated. For example, melting may be accomplished by electrical means, by plasma heating or by heating with hot combustion gases. A suitable hot gas is typically used to atomize and propel the molten metal against the target surface. The droplets solidify on the colder surface and fuse to form a dense coating.

In any event, in the application of thermal spray coatings, regardless of the particular technique, it has been a common practice to clean, roughen or abrade by blasting a grit such as small ground pieces of glass, aluminum oxide, silicon carbide, etc., that would roughen the surface, and then reclean the surface before the thermal spray coating is to be applied. For example, in the cast aluminum engine block application described above, the cylinder bore portions of the casting would be bored or otherwise machined slightly oversized to accommodate the thermal spray coating. Following this machining operation, it is necessary to solvent clean or degrease the cylinder bore portion of the casting so as to remove machine chips, lubricants and other dirt. Following the solvent cleaning operation, the surface of the cylinder bore is roughened by blasting with a commercial grit material, e.g., aluminum oxide, glass, silicon carbide or chilled iron of −30/+80 mesh size. Grit blasting roughens the surface so as to provide increased surface for adhesion and mechanical bonding between the base metal and the thermal spray coating. However, grit blasting creates the problem of ensuring that all of the grit is removed from the engine block in order to avoid the grit or abrasive contaminating parts of the engine. Further, the grit itself could probably lodge in crevices of the engine block or the cylinder bore surface itself. Thus, the use of grit or abrasives to roughen the surface requires subsequent cleaning of the entire area where the grit may be, which is a time-consuming operation. Also, there is no assurance that all of the grit has been washed out completely. In fact, it is practically impossible to assure all the grit has been removed from the areas where it may be contained as a result of the blasting operation.

Another disadvantage of using grit or abrasive slurries is that the abrasive or grit can even contaminate the surface being treated and although in many instances the roughed surface is suitable to hold the coating, increased tenacity of the roughed surface is desired. In accordance with the preferred embodiments of our invention, these problems are eliminated in a more economical way than one skilled in the art would ever conceive.

Accordingly, it is an object of the present invention to provide a simple, more efficient method of cleaning and roughening the surface of a metal alloy, especially the cast aluminum alloy of an engine's cylinder bore so that it is receptive to a thermal spray applied coating. It is a more specific object of the present invention to provide a one-step method of cleaning and roughening the machined aluminum alloy surface of an engine's cylinder bore so as to provide a grit-free engine and a grit-free improved surface texture for an adherent thermal spray applied metal coating.

BRIEF SUMMARY OF THE INVENTION

In accordance with a preferred embodiment of our invention, these an other objects and advantages are accomplished as follows. The practice of our invention will be described in connection with tile provision of a thermal spray, wear-resistant coating on the cylinder wall portion of an aluminum alloy engine block casting. However, it is to be appreciated that the same process steps and principles can be employed in the preparation of other aluminum alloys and indeed, other metal alloy surfaces for receiving thermal spray coatings.

An engine block is suitably cast of an aluminum alloy such as 319 aluminum alloy. This commercial alloy contains copper and about six percent (6%) by weight silicon. It is an excellent alloy for casting automotive engine blocks. However, it does lack suitable wear resistance on its cylinder wall surfaces.

The cylinder wall portions of the casting are machined by a boring operation to a diameter slightly oversize with respect to the desired finish diameter. A typical cast block would have four or more such cylinder bores. In accordance with our invention, tile machined cylinder wall surfaces are then thoroughly and uniformly blasted with a high pressure water jet exceeding 35,000 psi (pounds per square inch). The water jets have pressures between 35,000 and 55,000 psi and preferably about 50,000 psi particularly for the very best results in preparing the aluminum 319 alloy for coating as disclosed in Pat. No. 5,080,056.

In order to uniformly clean and roughen the cylindrical surfaces, a rotating water jet head is employed that can be moved reciprocally along the axis of the bore to uniformly treat the entire surface. The high velocity, high pressure water jet blast not only cleans the surface of machining debris and lubricants, but also surprisingly attacks the pores of the microstructure, that is, the interstices of the metal, so as to produce a surface texture consisting of relatively small pits with undercuts as compared to a grit-blasted surface. These pits with undercuts provide an excellent surface with superior mechanical/adhesive qualities for the application of a thermal-sprayed metal alloy coating. The finely pitted surface provides both increased surface area for metal/-metal adhesion and increased texture for mechanical interlocking between the metal casting and coating.

Our practice is useful in preparation of any suitable metal surface for a thermal spray coating. It is particularly beneficial for light-weight alloys such as aluminum alloys and magnesium alloys.

In the example of our aluminum engine block, we prefer to apply an aluminum-bronze alloy because it forms a strong bond with the underlying aluminum cast alloy and provides good wear resistance for an aluminum alloy piston with its piston rings to operate within the cylinder. The aluminum-bronze alloy may be applied by any suitable thermal spray process, of which several variations are known and in commercial use. We prefer to employ a high velocity oxy-fuel (HVOF) thermal spray practice such as that described in the U.S. Pat. No. 5,080,056 referred to above and incorporated herein by reference for purposes of the description of such thermal spray practice. In the HVOF thermal spray process as applied to internal cylindrical surfaces, a combustible mixture of propylene and oxygen flowing at supersonic speed is introduced down the center of a coating head and ignited and burned. The hot, high velocity gas is employed to melt the end portion of a continuously-fed wire of aluminum-bronze alloy and atomize it and propel the droplets against the adjacent wall of the cylinder. By employing a spray apparatus that automatically rotates within the cast cylinder wall and translates along its axis, a uniform, dense coating of the aluminum-bronze alloy is applied. The application is continued until a layer of suitable thickness is formed.

As soon as the coating has cooled, it is observed that it is somewhat rough but strongly adhered to the water jet-treated surface. We then hone this coating to remove enough of the thermally sprayed material to reach the desired internal diameter of the cylinder. This practice is carried out in each of the cylinder bores of the cast block. More than one bore may be processed at one time.

Other objects and advantages of our practice for treating a metal alloy surface will become more apparent in view of a detailed description of our invention that follows. During such detailed description, reference will be had to the drawings in which:

BRIEF DESCRIPTION OF THE DRAWINGS

FIG. 3A is a photomicrograph of a sand grit blasted surface in accordance with the prior art treatment, and FIG. 3B is a water jet cleaned and blasted surface in accordance with this invention;

FIG. 4A showing the surface untreated: FIG. 4B showing the surface after being treated by our method and apparatus and FIG. 4C disclosing the coated surface;

DETAILED DESCRIPTION OF A PREFERRED EMBODIMENT

As indicated above, we illustrate the preferred practice of our invention in the preparation of a cast 319 aluminum alloy engine block for the coating of the cylinder wall portions with a wear-resistant aluminum-bronze alloy. However, it is to be appreciated that our one-step cleaning and surface roughening process is applicable to the preparation of other suitable nonferrous metal surfaces, such as other aluminum alloys, magnesium alloys and titanium alloys to receive a coating. It is also to be appreciated that coatings other than thermal spray metal compositions may be applied to such cleaned and roughened metal surfaces.

Figure 1:
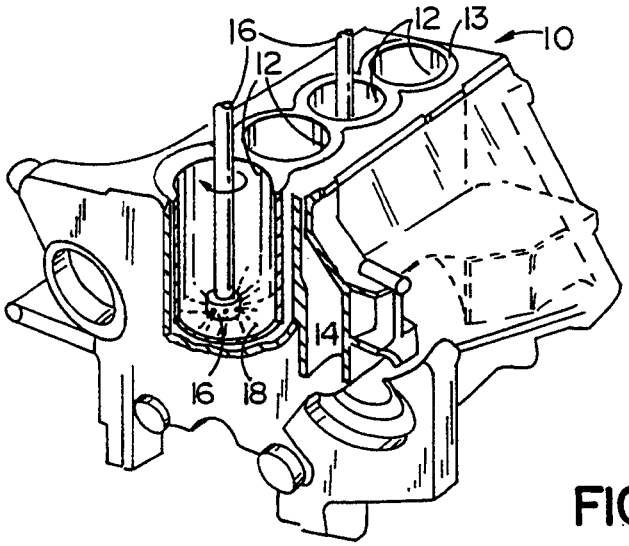
FIG. 1 is an isometric view of a cast aluminum, four cylinder engine block, partly broken away and in section, showing an apparatus for the treatment of the cast cylinder walls.

Referring to FIG. 1, a cast aluminum alloy 319 engine block for a four-cylinder engine is illustrated at 10. In the figure, one of the cylinder openings 12 including its wall 14 and the adjoining portion of the engine have been broken away to illustrate the cast cylinder wall surface. Illustrated in the cylinder 12 is a water jet spray nozzle 16 with water spray 18 impinging upon cylinder wall 14, cleaning and toughening its surface. Spent water simply drains from the cylinder through its lower opening. The overall practice of our invention is as follows.

The aluminum block is preferably cast of AA319 alloy, which is well known for its utility in both sand casting and permanent mold casting. The 319 alloy is a low silicon alloy having the composition and characteristics as set forth in the Metals Handbook, 8th Edition, *American Society of Metals* (page 956). It nominally comprises by weight 3.5% copper, 6.3% silicon and the balance aluminum and has a Brinell hardness as cast of 70–95. While this alloy is used for purposes of illustration in the practice of our invention, other aluminum alloys may be treated in a like manner.

It is believed that the criteria necessary for our invention to properly treat the surface requires a metal that has a Brinell hardness of between about 50–100. These alloys are the zinc alloy AG40A which has a composition of 95.96% zinc. 4% aluminum and 0.04% magnesium and a Brinell hardness of 82; a copper-hardened, rolled zinc having the composition of 99% zinc and 1% copper and a Brinell hardness of 60; a rolled zinc alloy having a composition of 98.99% zinc, 1% copper and 0.010% magnesium and a Brinell hardness of 80; a magnesium alloy AM100A having a composition of 89.9% magnesium, 10% aluminum and 0.1% manganese with a Brinell hardness of 52–69; a magnesium alloy AZ63A having a composition 90–98% magnesium, 6% aluminum, 3% zinc and 0.2% manganese with a Brinell hardness of 50–73; a magnesium alloy AZ92A having a composition of 88.99% magnesium, 9% aluminum, 2% zinc and 0.1% manganese and a Brinell hardness of 63–81; and the magnesium alloy AZ31B having a composition of 95.98% magnesium, 3% aluminum, 1% zinc and 0.2% manganese with a Brinell hardness of 49–73. This process also applies to titanium alloys as well as those described above. The only composition that we have tested is the 319 aluminum alloy which has a Brinell hardness of 70–95 (see above), although we believe our method and apparatus will properly treat the above-listed other alloys.

In FIGS. 2A–2D, the engine cylinder bodies 13 are shown free-standing for purposes of clear illustration. It is to be understood that they are actually integrally cast with the block 10 as shown in FIG. 1.

Figure 2D:
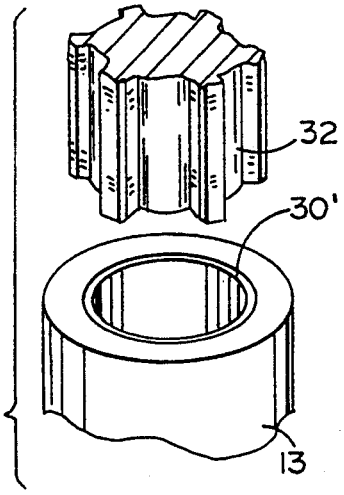
FIG. 2D illustrates the honing of the cylinder wall to its finished dimension.
Figure 2A:
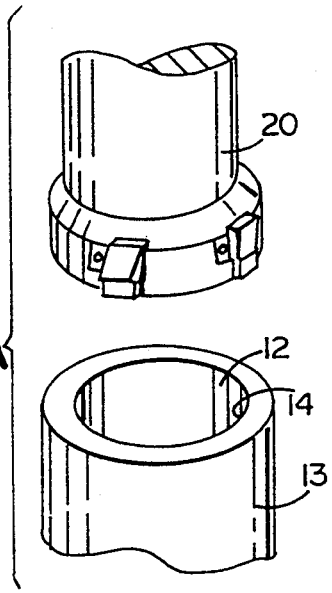
FIG. 2A illustrates the boring of the cast cylinder wall.

As illustrated in FIG. 2A, the wall 14 of each cylinder 12 of the cast block is subjected to a boring operation by a bore head 20 to uniformly size the cylinder to a slightly larger internal diameter than that desired in the final product.

Figure 2B:
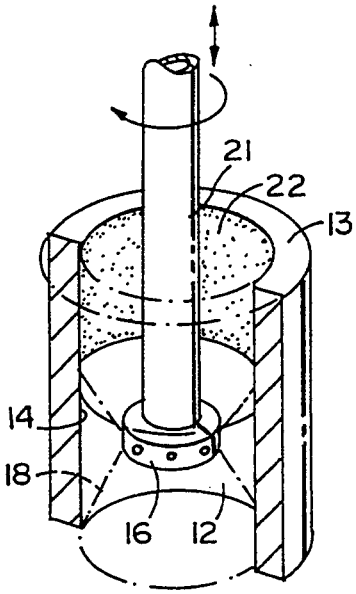
FIG. 2B illustrates the water jet cleaning/surface roughening treatment of the cylinder wall.

FIG. 2B illustrates the water jet cleaning and surface roughening step, which is an essential and critical feature of our invention. Water jet equipment is readily available commercially because it is used in a number of processing operations such as the cutting of fabrics, other plastics, wood, paper, glass and some metals, the removal of all kinds of coatings from various substrates and the breaking of concrete and the like. In the practice of our invention for the treatment of cylinder walls, we employ water jet apparatus comprising a rotating spray head that is translated vertically along the axis of the cylinder opening 12 by apparatus such as disclosed in FIG. 7 which will be described hereinafter. One or more cylinders 13 may be treated at a time. As illustrated schematically in FIG. 2B, the water jet apparatus 16 rotates. It is also moved up and down in the cylinder to wash away all debris, dirt, oil and the like which would provide a local barrier between the treated aluminum alloy cylinder wall surface and the thermal spray alloy to be applied. At the same time, this high pressure jet abrades the surface so as to form a large number of very small pits with undercuts which provide increased surface area and mechanical interlock features for adherence of the thermal spray coating.

Figure 3A:
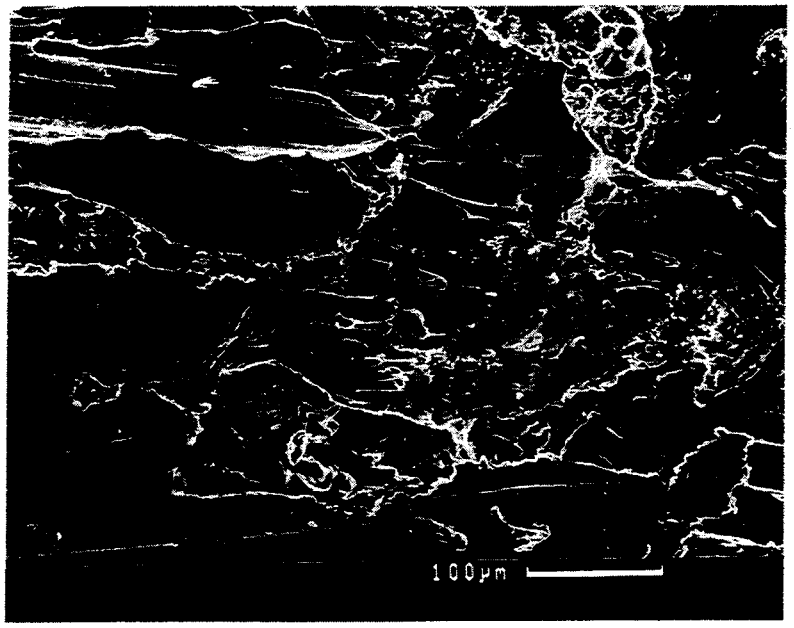
PRIOR ART Fig. 3A
FIGS. 3A and 3B are photomicrographs at 200× of roughened cylinder wall surfaces of 319 aluminum alloy which have been treated for the application of the thermal spray coating.
Figure 3B:
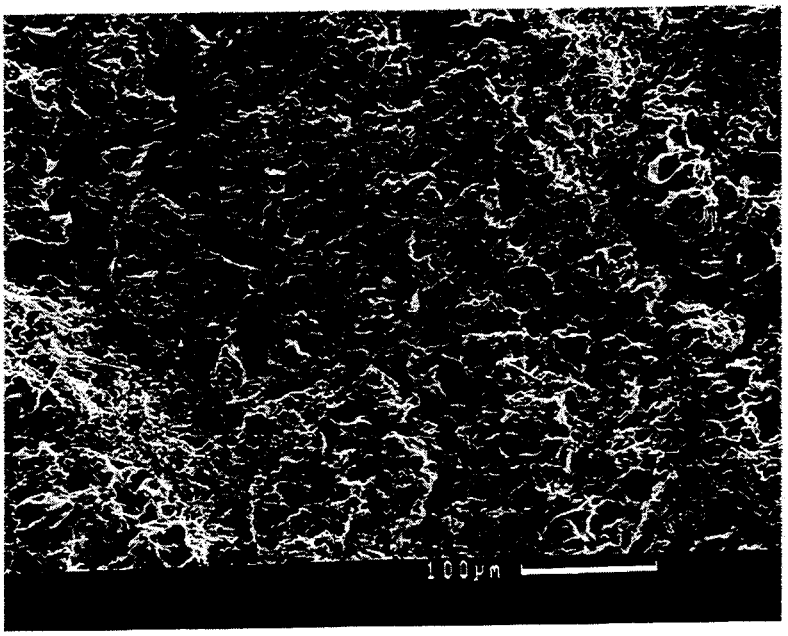

The actual water jet surface is depicted by the reproduced photos of FIG. 3B and indicated at 22 in FIG. 2B. The pitted surface is shown by the dotted texture of the schematic figure in 2B.

We employed a water jet apparatus made by Flow International Corporation of Kent, Wash. It utilized intensifier pumps with the capability of pressuring the water to 55,000 psi or higher. The water is forced through nozzles typically 0.003 to 0.007 inches in diameter (preferably 0.005 inches) and exits at speeds up to 3000 feet/second. We prefer to employ pressures in the range of about 35,000 to 55,000 psi to obtain the preferred surface texture. The spray nozzle was like that depicted in FIG. 2B. The spray head was a small disc having eight nozzles (three shown in FIG. 2B). The spray disc was rotated at a speed of 500–1500 rpm, preferably 1000 rpm, and traversed the axis of the cylinder in and out once in a five-and-one-half inch stroke at a rate of about 5 to 10 inches per minute. The ideal standoff distance, that is the distance from the edge of the head to the wall of the cylinder bore, was one-half to one inch. Water was sprayed at a rate of 0.928 gallons per minute. Our in-and-out passage of the spray nozzle required about two minutes. $2.74\times10^{-4}$ gallons per square inch per second of spraying were delivered in the form of high velocity, high pressure jets against the surface of the bored cylinder wall. We view a spray lower level of 1.80 to $3.6\times10^{-4}$ gal/in$^2$/sec as suitable for cleaning and toughening 319 aluminum alloy. The result was not only to thoroughly clean the surface, but to roughen it as depicted in FIG. 3B. Variables in the standoff distance, the speed of rotation and the traverse rate will vary depending upon the metal being treated, the extent of the aggressive surface desired and the pressure of the water jets. Greater water jet pressures and/or increases in the time of treatment produce more aggressive surfaces.

FIG. 3B is a photomicrograph at 200× of the water-blasted surface of the AA319 alloy cylinder wall surface. The photomicrograph reveals that the surface is fairly uniformly pitted. The mean peak-to-peak spacing is quite close. It has been determined to be approximately 20 μm in this example. In general, we prefer that the intensity and duration of the water blast treatment in accordance with our invention be such that the resultant surface be characterized by a mean peak-to-peak spacing of about 50 μm or less. The average depth of the water-eroded pits is about 75 to 10 μm. Other small pits in the casting may be uncovered by the water erosion.

Figure 4A:
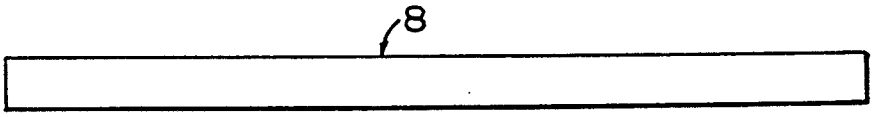
FIGS. 4A, 4B, and 4C schematically illustrate the sequential condition of a metal surface treated in accordance with our invention and then coated.
Figure 4B:
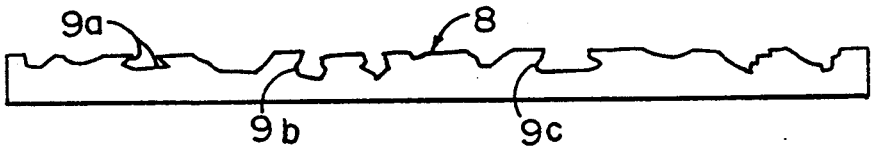
Figure 4C:
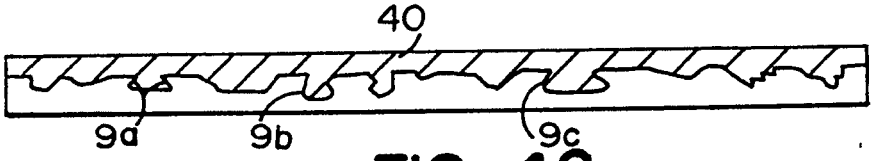

FIGS. 4A, 4B, and 4C schematically illustrate the unusual result obtained by the present method and apparatus. FIG. 4A discloses a surface such as a very small section of the surface 12 of one of the cylinders 2. It discloses a relatively smooth surface which has been prepared by the boring operation of FIG. 2A. FIG. 4B discloses the surface 22 after it has been treated by our method and with our apparatus. It will be noted that the high pressure water jets have, in fact, eroded the surface. It is not cut into the surface such as might occur with grit such as glass particles, but has actually eroded and formed undercut portions such as 9*a*, 9*b*, and 9*c*. It is believed some metal structures have a porosity which is exposed by the erosion of the surface leaving a surface that is undercut. The addition of the undercuts in tile surface advances the adhesive characteristics of the surface. Also. the erosion greatly increases the surface area. Therefore, the configuration of the irregular wall surface 14 after treatment by our method and apparatus provides for superior adhesion. This is illustrated by FIG. 4C, which discloses the coating 40 that is held to and retained by the increased surface area and particularly by the undercuts 9a, 9b, 9c, and others not specifically designated.

In contrast with water jet blasting, grit blasting produces a much different, less pitted surface texture. FIG. 3A is a photograph at 200× of a cylinder wall of the same composition. The surface was grit blasted with crushed steel 16A. 60 grit size, for approximately 30 seconds at 100 psi air pressure and subsequently cleaned. This is considered a suitable practice for preparation of a thermal spray coating on an AA319 alloy. This mean peak-to-peak spacing of this surface is about 230 μm.

Following the water jet cleaning and roughening operation, an aluminum-bronze alloy coating was applied as described in the above-identified U.S. Pat. No. 5,080,056.

The aluminum-bronze alloy coating is readily applied by the HVOF process to form an adherent coating on the water jet-roughened surface. A few examples of commercially available aluminum-bronze alloys with their nominal compositions are aluminum-bronze with 95% copper and 5% aluminum; aluminum-bronze with 91% copper and 9% aluminum; aluminum-bronze with 91% copper, 7% aluminum and 2% iron; aluminum-bronze with 89% copper, 10% aluminum and 1% iron; aluminum-bronze with 85% copper, 11% aluminum and 4% iron; aluminum-bronze with 81% copper, 11% aluminum, 4% iron and 4% nickel; and other like compositions as described in the above-referenced '056 patent.

Figure 2C:
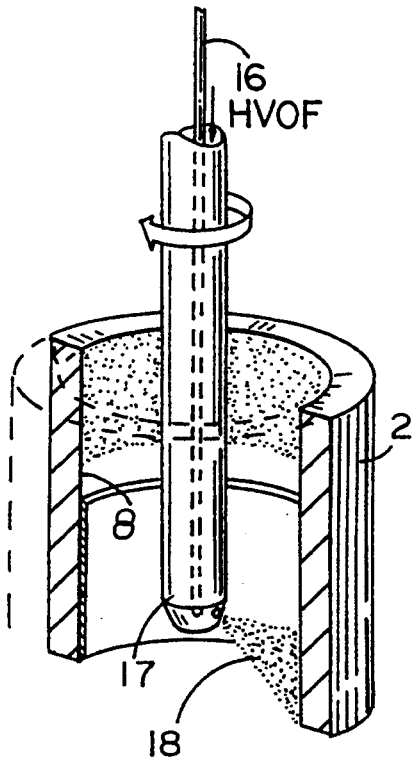
FIG. 2C illustrates the application of the thermal spray coating to the cylinder wall.

The application of this alloy in tile form of a wire 24 fed to an HVOF spray gun 26 is depicted in FIG. 2C. Reference is had to the '056 patent for a more detailed description of the spray apparatus. However, in the practice of this process in this instance, we employed an HVOF apparatus as illustrated with spray in FIG. 2C. It was capable of rotating rapidly and translating along the axis of the cylinder bore. The spray gun travels along the cylinder axis at about 100 inches per minute while rotating at 800 rpm. Propylene with oxygen-enriched air flows down the tubular gun 26 as indicated by the arrow. The mixture is ignited near the nozzle, and it melts and atomizes the end of the wire and propels the molten alloy droplets as a spray 30 onto cylinder wall 14 where they solidify as dense, adherent aluminum-bronze coating 30'.

The coating of aluminum-bronze alloy was continued until a layer 30' of about 0.040 inches had been formed on the internal diameter 14 on each cylinder 13. The spray nozzle 26 was moving rapidly up and down in the cylinder 12 while rotating to apply molten droplets of aluminum-bronze composition on the cylinder wall. A ⅛-inch diameter wire 24 of aluminum-bronze composition was used which consisted of about 9 to 11 weight percent aluminum, 1 weight percent iron, 0.2 weight percent tin and tile balance copper. A mixture of 149 SCFH propylene, 606 SCFH oxygen and 1260 SCFH air was used as the fuel and fluidizing mixture that propelled the molten mixture against the cylinder walls.

After a suitable thickness of the aluminum-bronze alloy has been applied to the cylinder walls, a suitable rotating cutting tool such as a honing tool 32 depicted in FIG. 2D was employed to machine the applied coating to within 0.005 inches of the desired final diameter of the bore. Sufficient excess coating material is applied so that about 30% of the coating layer is removed. A suitable finish honing tool is employed to hone the bore to its in final diameter and roughness.

Figure 7:
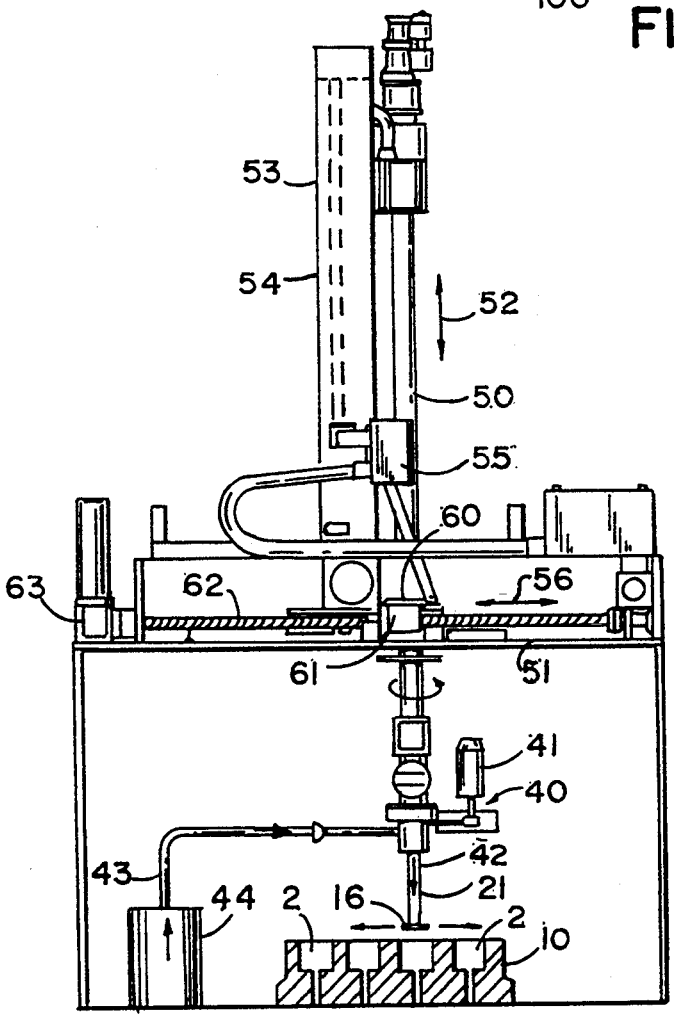
FIG. 7 discloses an apparatus for moving either of the two rotating: heads as disclosed in FIGS. 1, 2B, 2C, and 5.

FIG. 7 discloses a robot mechanism for producing the motions as described in relation to FIGS. 1 and 2. In FIG. 7, reference numeral 31 designates the conduit 21 as disclosed in FIGS. 1 and 2. It is rotated by a rotary lance drive mechanism 40 of the type disclosed in patent application Ser. No. 688,725 filed on Apr. 19, 1991, by Leonid B. Gelfand and assigned to the assignee of the present invention. It includes a motor 41 which drives the lance 42 to which the conduit 21 and the cylinder head 16 are attached and rotatable therewith. The unit 40 includes a passageway member extending from one side to which the water conduit 43 is connected. A high pressure pump 44 of the type known as an ultra-high pressure water intensifier sold by Flow Systems International as Model 12XT is connected to the conduit 43 for supplying water under pressure to the rotating conduit 21 and water jet spray nozzle 16.

The unit 40 is secured to the bottom end of a mast assembly 50 which extends upwardly through the roof of compartment 51 and is adapted to be moved upwardly and downwardly as disclosed by the arrows 52. This is accomplished by the mast being connected to a screw 53 located in the housing 54. The screw 53 is rotated by the motor 55. The actuation of this mast in a vertical up and down direction is similar to that disclosed in the assignee's co-pending application Ser. No. 509,945 entitled "Five Access Robot," filed on Apr. 16, 1990 (now Pat. No. 5,067,285 issued Nov. 26, 1991). Both applications Ser. Nos. 688,725 and 509,945 are incorporated within this application by reference.

Although when the lateral position of conduit 21 and the water jet spray nozzle 16 is once established, it is not necessary to change such lateral position in the treatment of one cylinder, when one nozzle 16 is to be utilized to treat different cylinders such as those disclosed in FIGS. 1 and 7, it is desirable to move the entire unit 40 and mast 50 laterally from right to left as disclosed by arrows 56 in FIG. 7. For that purpose, a carriage 60 is provided which is attached to a nut 61 which is mounted for movement on the screw 62. The screw 62 is actuated by a motor 63 so that turning of the screw 62 moves the nut 61 and the carriage 60. An example of this type of apparatus is disclosed in U.S. Pat. No. 5,067,285 issued Nov. 26, 1991, and is owned by the assignee of this invention. The disclosure of such patent is incorporated within this description by reference.

The resultant aluminum-bronze coating is fully dense, essentially pore-free and provides an excellent scuff surface for the operation of an aluminum piston within a fully assembled engine. Moreover, the employment of the water jet cleaning and surface roughening practice of our invention provides a base surface for the thermal spray coating which forms an extremely strong bond between the coating and the base layer.

We have measured the stress required to strip off thermal spray coatings applied to a grit-blasted surface (like FIG. 3A) and find that it is of the order of 3000 psi. In contrast, the stress required to remove thermal spray coatings applied on a water jet-treated surface (like FIG. 3B) is of the order of 6000 psi.

While we do not wish to be bound by a theoretical reason for the improved bond strength on water-blasted surfaces, the reason may be perceived from a comparison of FIGS. 3A and 3B. In the text above, we have compared the marked difference in the size and number of pits per unit of surface area that are formed by grit blasting versus water jet blasting. We believe that our water jet blasting practice provides a surface much more receptive to thermal spray coatings. In the application of thermal spray coatings, the molten droplets are quenched quite rapidly on the target surface. Apparently, there is little time for the deposited metal to diffuse into the substrate to form a metallurgical bond. However, the droplets can flow into and fill the large number of small pits with undercuts formed by our water blasting practice. The result is a large number of interlocking mechanical bonds that strengthen the adherence between the coating and the substrate.

Our water jet method is applicable to the preparation of metal alloy surfaces to receive thermal spray metal alloy coatings. It has been described in terms of the specific combination of cast aluminum alloy substrates and thermal spray coatings of wear-resistant aluminum alloys because this combination lends itself to the application of our process and is a very important application in the automotive field.

Thermal spray coatings of aluminum bronze on cast aluminum alloys like 319 not only provide good wear resistance but provide good adherence to the substrate. Such adherence is greatly improved as shown above by our water jet cleaning/roughening practice. In addition to the benefits of our process, the adherence of aluminum-bronze to the 319 aluminum alloy is also improved by the relatively closely matched thermal expansion of the thermal spray alloy to the cast aluminum alloy.

Previous efforts to use other thermal spray wear-resistant materials such as the low-cost ferrous alloys have resulted in low adhesion to aluminum alloys due to the high shrinkage of the ferrous alloys upon coating solidification. In these instances, the aluminum surface had been prepared using the standard practice of grit blasting and vapor degreasing.

We have successfully applied low alloy steel thermal spray coatings to the cylinder walls of AA319 alloy after treatment of the cast surfaces by water jet. We treated the cylinder walls with the water jet as described above to form a clean pitted surface as illustrated in FIG. 3B. We thus utilized the HVOF process to a thermal spray SAE 1025 steel coating on the pitted aluminum surface.

Metco Spray Steel 25 wire was used in the HVOF apparatus described above. This steel is a silicon-killed composition consisting nominally of, by weight, 0.23% carbon, 0.04% each phosphorus and sulfur, 0.6% manganese, 0.1% silicon and the balance iron.

As above, the spray gun was rotated at 800 rpm while traveling along the cylinder axis at about 200 inches per minute. A mixture of 100 SCFH propylene, 425 SCFH oxygen and 1000 SCFH air was used to melt, fluidize and propel the molten steel against the pitted aluminum surface. The engine block was preheated and cooled with water at 180° F. during the coating. The steel wire was advanced at 41 inches/minute.

A dense, adherent steel coating was formed on the pitted aluminum without the need for an intermediate coating of lower shrinkage material. The steel coating was honed to a final desired dimension.

Figure 5:
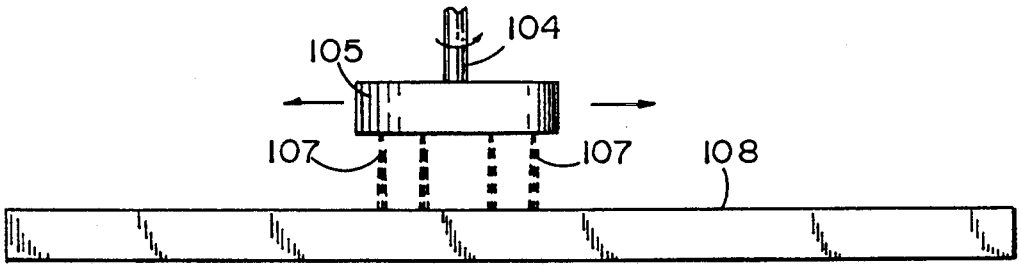
FIGS. 5 and 6 disclose another embodiment of our invention as it applies to the treatment of a fiat surface rather than a cylindrical surface.
Figure 6:
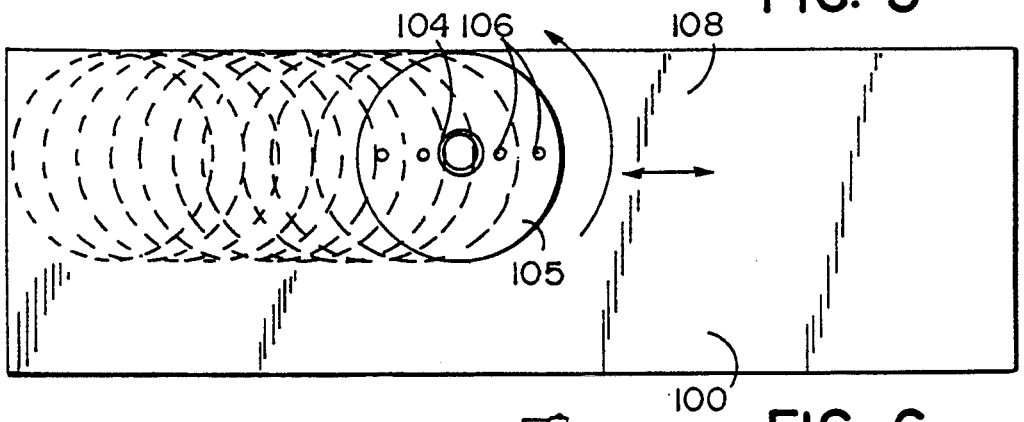

Having conceived this method and apparatus for treating the cylindrical walls of an aluminum engine block by subjecting the walls to extremely high pressure water jets, we also conceived that our method and apparatus could be utilized in flat pieces or other forms of metal, particularly malleable ductile metal having surface hardnesses like that of the aluminum 319 alloy as referred to above. FIGS. 5 and 6 disclose schematics of apparatus for treating such surfaces.

FIG. 5 discloses a tubular water conduit 104 connected to a cylindrical head 105. The head has a plurality of orifices 106 the same size as orifice 6 of FIGS. 1 and 2. Orifices 106 are located on the bottom surface of the cylinder 105. Thus, the jets 107 are directed downwardly on the surface 108; the spacing between the bottom of the cylindrical head 105 being approximately one to one-half inch. It should be understood that the speed of the rotation of the conduit 104 and head 105, the pressure of the water jets 107 and the standoff distance, i.e., the distance between the bottom face of the head 105 and the surface 108, are preferably the same as that previously disclosed with relation to FIGS. 1 and 2, although such parameters can change depending upon many circumstances all as described above.

The conduit 104 and head 105 are moved by an apparatus such as disclosed in FIG. 7. Thus, the conduit 104 would be attached to the lance 12 and in place of the engine block 1 the workpiece 100 would be substituted. All of the advantages enumerated above with relation to FIGS. 1 and 2 would also be obtained by our invention as applied to a fiat or contoured piece such as the workpiece 100 of FIGS. 5 and 6.

While our invention has been described in terms of a specific embodiment thereof, it will be appreciated that other forms of our process could readily be adapted and, therefore, the scope of our invention is to be considered limited only by the following claims.

The embodiments of the invention in which an exclusive property or privilege is claimed are defined as follows.

1. The method of coating a surface comprising a malleable light metal with a wear-resistant coating material comprising the steps of:

roughening said surface by creating jets of water having pressures sufficiently high to clean and erode the surface to provide a pitted surface with undercuts so that said surface is provided with a mechanical/adhesive bond for said coating;

directing said jets against said surface to prepare said surface for application of said wear-resistant coating by cleaning and eroding said surface to provide a pitted surface with pits and undercuts;

after said water jet roughening step and without further roughening said surface, providing wear-resistant coating material; and applying said wear-resistant coating material on said roughened surface whereby said coating material fills said pits and undercuts to mechanically/adhesively bond said coating to said surface.

2. The method of claim 1 in which the pressures of the jets created are between 35,000 and 55,000 psi so as to erode said surfaces and provide undercut portions thereof.

3. The method of claim 2 in which the pressures of said jets are about 50,000 psi.

4. The method of claim 1 in which the step of applying said coating is by thermal spraying.

5. The method of claim 1 in which said metal surface has a Brinell surface hardness of about between 50 and 100.

6. The method of claim 5 in which the metal surface has a Brinell surface hardness of about between 70 and 95.

7. The method of claim 1 in which the pressures of the jets created are between 35,000 and 55,000 psi.

8. The method of coating the metal surface of a cylinder bore of an engine block with a wear-resistant coating material comprising the steps of:

roughening the surface of said cylinder bore by creating jets of water having pressures sufficiently high to clean and erode the surface of said cylinder bore to provide a pitted surface with undercuts so that said surface is provide with a mechanical/adhesive bond for said coating;

directing said jets against said surface of said cylinder bore to roughen said surface for application of said wear-resistant coating by cleaning and eroding said surface to provide a pitted surface with pits and undercuts;

after said water jet roughening step and without further roughening of said surface, providing wear-resistant coating material; and applying said wear-resistant coating material on said roughened surface whereby said coating material fills said pits and undercuts to mechanically/adhesively bond said coating to the surface of said bore.

9. The method of claim 8 in which the pressures of the jets created are between 35,000 and 55,000 psi so as to erode said surfaces and provide undercut portions thereof.

10. The method of claim 9 in which the pressures of said jets are about 50,000 psi.

11. The method of claim 8 in which the metal surface of said cylinder bore is constructed of a malleable ductile light metal.

12. The method of claim 8 in which said metal surface has a Brinell surface hardness of about between 50 and 100.

13. The method of claim 12 in which the metal surface has a Brinell surface hardness of about between 70 and 95.

14. The method of claim 8 in which the metal surface is an aluminum alloy.

15. The method of claim 8 in which the step of applying said coating is by thermal spraying.

16. The method of claim 5 in which the coating is a material selected from the group consisting of aluminum-bronze alloys and low carbon alloy steel applied by a high velocity oxygen fuel process.

17. In the process of applying a wear-resistant coating material on a cast aluminum alloy metal surface wherein the surface is cleaned and roughened prior to applying the coating material to said surface, the improvement comprising:

cleaning and concomitantly roughening the metal surface to be coated by directing a jet of water at pressures between 35,000 and 55,000 psi against the surface to remove extraneous matter and simultaneously eroding the surface to provide a pitted surface with pits and undercuts; and after said water jet cleaning and roughening step and without further roughening of said surface, applying said coating material to said surface whereby said coating material fills said pits and undercuts to provide a layer of said coating material bonded to said surface with a mechanical/adhesive bond.

18. A method of forming a coating as recited in claim 17 wherein the pits the roughened surface have a mean peak-to-peak spacing of about 50 μm or less.

19. A method of forming a coating as recited in claim 17 wherein the coating material is a thermal spray metal selected from the group consisting of aluminum-bronze alloys and low carbon, low alloy steels and which is applied to the water jet blasted aluminum surface by a high velocity oxygen-fuel process.

20. In the process of applying a wear-resistant coating material on the surface of a metal alloy selected from the group consisting of aluminum magnesium and titanium alloys wherein the surface is cleaned and roughened prior to applying the coating material to said surface, the improvement comprising:

cleaning and concomitantly roughening the metal alloy surface to be coated by directing a jet of water at pressures between 35,000 and 55,000 psi against the surface to remove extraneous matter and simultaneously toughening the surface to provide a pitted surface with pits and undercuts; and after said water jet cleaning and roughening step and without further roughening of said surface applying said coating material to said surface whereby said coating material fills said pits and undercuts to provide a layer of said coating material bonded to said surface with a mechanical/adhesive bond.

21. A method of forming a coating as recited in claim 20 wherein the pits the roughened surface have a mean peak-to-peak spacing of about 50 μm or less.

22. A method of forming a coating as recited in claim 20 wherein the coating material is a thermal spray metal selected from the group consisting of aluminum-bronze alloys and low carbon, low alloy steels and which is applied the water jet blasted aluminum surface by a high velocity oxygen-fuel process.

* * * * *

UNITED STATES PATENT AND TRADEMARK OFFICE

CERTIFICATE OF CORRECTION

PATENT NO. : 5,380,564

DATED : January 10, 1995

INVENTOR(S) : Lewis L. VanKuiken, Jr. et al.

It is certified that error appears in the above-indentified patent and that said Letters Patent is hereby corrected as shown below:

Column 1, line 7:
"1993" should be --1992--.

Column 2, line 56:
"tile" should be --the--.

Column 3, line 5:
"tile" should be --the--.

Column 4, line 31:
"fiat" should be --flat--.

Column 4, line 34:
After "rotating" delete --:--.

Column 4, line 58:
"toughening" should be --roughening--.

Column 6, line 25:
"toughening" should be --roughening--.

Column 6, line 61:
"tile" should be --the--.

Column 6, line 63:
"Also." should be --Also,--.

Column 7, line 7:
"16A." should be --16A,--.

UNITED STATES PATENT AND TRADEMARK OFFICE

CERTIFICATE OF CORRECTION

PATENT NO. : 5,380,564 Page 2 of 3

DATED : January 10, 1995

INVENTOR(S) : Lewis L. VanKuiken, Jr. et al.

It is certified that error appears in the above-indentified patent and that said Letters Patent is hereby corrected as shown below:

Column 7, line 31:
"tile" should be --the--.

Column 7, line 56:
"tile" should be --the--.

Column 10, line 22:
"fiat" should be --flat--.

Column 11, line 42, claim 16:
"claim 5" should be --claim 15--.

Column 12, line 14, claim 18:
After "pits" insert --of--.

Column 12, line 32, claim 20:
"toughening" should be --roughening--.

Column 12, line 42, claim 21:
After "pits" insert --of--.

UNITED STATES PATENT AND TRADEMARK OFFICE

CERTIFICATE OF CORRECTION

PATENT NO. : 5,380,564

DATED : January 10, 1995

INVENTOR(S) : Lewis L. VanKuiken, Jr. et al.

It is certified that error appears in the above-indentified patent and that said Letters Patent is hereby corrected as shown below:

Column 12, line 48, claim 22:
After "applied" insert —to—.

Signed and Sealed this

Second Day of January, 1996

Bruce Lehman

*Attest:*

BRUCE LEHMAN

*Attesting Officer*

*Commissioner of Patents and Trademarks*